US008376058B2

(12) United States Patent
Adamson

(10) Patent No.: US 8,376,058 B2
(45) Date of Patent: Feb. 19, 2013

(54) WELL DRILLING WASH DOWN END CAP AND METHOD

(76) Inventor: David K. Adamson, Meridian, ID (US)

( * ) Notice: Subject to any disclaimer, the term of this patent is extended or adjusted under 35 U.S.C. 154(b) by 480 days.

(21) Appl. No.: 12/621,117

(22) Filed: Nov. 18, 2009

(65) Prior Publication Data

US 2011/0114339 A1 May 19, 2011

(51) Int. Cl.
*E03B 3/18* (2006.01)
*E03B 3/24* (2006.01)
*E21B 43/02* (2006.01)

(52) U.S. Cl. ..... 166/386; 166/278; 166/158

(58) Field of Classification Search ..... 166/157, 166/158, 205, 227, 242.8, 312, 278, 386
See application file for complete search history.

(56) References Cited

U.S. PATENT DOCUMENTS

| | | | | |
|---|---|---|---|---|
| 2,035,313 | A * | 3/1936 | Griffin | 175/314 |
| 2,092,042 | A * | 9/1937 | Arm et al. | 166/235 |
| 2,124,830 | A | 7/1938 | Roth | |
| 2,336,168 | A * | 12/1943 | Eckel | 166/246 |
| 2,717,040 | A * | 9/1955 | Sidney Paish Harold Philip | 175/314 |
| 2,726,723 | A | 12/1955 | Wilhoit et al. | |
| 2,833,354 | A * | 5/1958 | Sailers | 166/205 |
| 2,835,328 | A * | 5/1958 | Thompson | 175/314 |
| 3,163,229 | A | 12/1964 | Salisbury | |
| 3,302,722 | A * | 2/1967 | Madeley, Sr. | 166/157 |
| 3,314,481 | A * | 4/1967 | Willman et al. | 166/205 |
| 3,358,781 | A * | 12/1967 | Cotton | 175/314 |
| 4,819,722 | A | 4/1989 | Daly | |
| 5,901,789 | A | 5/1999 | Donnelly | |
| 6,062,307 | A | 5/2000 | Hamid | |
| 6,236,966 | B1 | 5/2001 | Fleming | |
| 6,315,040 | B1 | 11/2001 | Donnelly | |
| 6,416,661 | B1 | 7/2002 | Cordry | |
| 6,454,013 | B1 | 9/2002 | Metcalfe | |
| 6,571,871 | B2 | 6/2003 | Lauritzen | |
| 6,722,443 | B1 | 4/2004 | Metcalfe | |
| 6,742,598 | B2 | 6/2004 | Whitelaw | |
| 6,832,649 | B2 | 12/2004 | Bode | |
| 6,851,560 | B2 | 2/2005 | Reig | |
| 6,868,905 | B2 | 3/2005 | Lauritzen | |
| 6,896,057 | B2 | 5/2005 | Metcalfe | |
| 6,920,935 | B2 | 7/2005 | Metcalfe | |
| 6,971,685 | B2 | 12/2005 | Hashem | |
| 7,124,830 | B2 | 10/2006 | Metcalfe | |
| 7,140,446 | B2 | 11/2006 | Metcalfe | |
| 7,213,642 | B2 | 5/2007 | Kerfoot | |
| 7,249,631 | B2 | 7/2007 | Rouse | |
| 2004/0163819 | A1 | 8/2004 | Johnson | |

(Continued)

OTHER PUBLICATIONS

Baker Oil Tools, Expand Your Sand Control Options with EXPress Expandable Screens, Informational Pamphlet, Pub. No. BOT-04-6115, 2004, Houston, TX.

(Continued)

*Primary Examiner* — Shane Bomar
*Assistant Examiner* — Robert E Fuller
(74) *Attorney, Agent, or Firm* — Robert L. Shaver; Dykas & Shaver

(57) ABSTRACT

An end cap for a well drilling screen for use in a water producing well. The end cap provides a water jet for use in inserting the screen into a layer of sand, and includes a check valve which prevents sand and particulates from entering the well tube. Also provided is a connection which allows the end cap to disengage from a drill string.

1 Claim, 2 Drawing Sheets

U.S. PATENT DOCUMENTS

| | | | |
|---|---|---|---|
| 2004/0194968 | A1 | 10/2004 | Metcalfe |
| 2004/0261994 | A1 | 12/2004 | Nguyen |
| 2005/0194148 | A1 | 9/2005 | Kerfoot |
| 2005/0199385 | A1 | 9/2005 | Metcalfe |
| 2005/0279514 | A1 | 12/2005 | Metcalfe |
| 2006/0065408 | A1 | 3/2006 | Green |

OTHER PUBLICATIONS

Ohio Department of Natural Resources, Well Screens and Development Techniques, Fact Sheet, Jan. 7, 1993, Columbus, OH.

* cited by examiner

WELL DRILLING WASH DOWN END CAP AND METHOD

PRIORITY/CROSS-REFERENCE TO RELATED APPLICATIONS

This application claims the priority date of the provisional application entitled DRILLING SCREEN CAP, filed on Jun. 9, 2008, with application Ser. No. 61/059,972, the disclosure of which is incorporated by reference.

FIELD OF THE INVENTION

The invention generally relates to an apparatus for use in well drilling, and more particularly to an end cap for attaching to a screen section of pipe used in a well for water.

SUMMARY OF THE INVENTION

The invention is a well drilling end cap for use at the bottom of a well casing in a situation where a screen is to be left in a layer of sand. Such a screen is typically left in place in a well so that water may pass through the sand layer and into the screen, and then may be pumped up the casing of the well for use at ground level. In such a situation, a five inch headpipe is typically attached to a section of screen and that screen is pressed into the sand layer. The screen must be washed into the sand layer with a jet of water, so that the sand is displaced and is fluid in nature when the screen is pressed into the sand. The end cap of the invention helps with that process.

The invention is an end cap body which is configured to be attached to the section of screen. The section of screen is attached to a five inch headpipe and this whole assembly is inserted into the bottom of a well casing, and pushed into the sand layer below the well casing. The end cap body has a rim for attachment to the screen. The end cap body comprises a tapering frustoconical interior surface which tapers towards a set of threads. The threads are for receiving a threaded coupling attached to the drill string. The threaded coupling is called a drill string coupling. The tapering interior surface is frustoconical, or generally funnel shaped, so that the drill string coupling and the attached drill string can be screwed into the end cap body and be guided into contact with the threads. At a second end of the end cap body, there is a water injection nozzle.

Inside the end cap body is a check valve which allows water to flow out of the nozzle and into the sand layer, but does not allow water to flow from the sand layer into the nozzle. The check valve can be at the end of the nozzle, or can be located in the interior of the end cap body.

The threads in the interior of the end cap body are left-handed threads so that a drill string and the attached drill string coupler may be turned clockwise in order to disengage from the end cap body. In this manner, when the drill string is turned in a clockwise manner, the coupler attached to the drill string disengages from the end cap body but the other threaded connections in the drill string tend to tighten under a clockwise rotation.

The end cap body rim may be attachable to the screen bottom by means of welding, or by threaded connection.

The check valve of the end cap body can be a ball and spring type valve, or it can be a flapper type check valve.

In use, the drill string coupler is attached to a two inch drill string, and the drill string coupler is threaded counterclockwise into the end cap body. The rim of the end cap body is attached to the screen, and the screen is attached to a five inch headpipe. Packers and packer wipers are placed between the five inch headpipe and the casing of the well, and are sized so that the five inch headpipe can pass through the packers and packer wipers with the five inch headpipe compressing the packer wipers and the packers. The packers are typically manufactured with rubber rings permanently attached. The drill string with the attached screen and five inch headpipe is then inserted into the well casing and through the packer wipers. The drill string pushes the screen to the vicinity of the sand layer below the well casing. Water is injected into the drill string, and flows out the end of the end cap body. The jet of water coming out the end of the end cap body drills a hole in the sand layer, and causes the sand in that area to be fluidized. Into this region of fluidized sand, the drill string presses further and presses until the screen is partially extending from the drill casing, and is partially within the drill casing. At that point, the flow of water can stop, and the check valve will keep water from flowing through the end cap body. However, water can still flow through the screen, but the screen keeps the sand out. Water can also flow up the casing pipe, between the casing and the five inch headpipe, but the sand is prevented from flowing past the packer wipers.

At this point, the two inch drill string may be removed by turning it clockwise, which causes the drill string coupler to disengage from the end cap body, and also causes the threaded connections of the drill string to tighten. Once disengaged from the end cap body, the drill string and the attached drill string coupler can be removed from the well. Once the drill string is removed, water may freely enter the screen and flow into the five inch headpipe and the casing of the well, and it may be pumped from the well to the surface.

The invention is also a method of performing these steps. The method is a method of inserting a screen into an underground layer of sand which has been reached by a drill casing. It comprises the steps of:

The first step is attaching a drill string coupler with right-hand threaded threads and left-handed threads to a drill string using the right-handed threads.

The next step is inserting packer wipers into the interior of the casing at a point above the end of the casing.

The next step is attaching a screen configured for a tight fit with the packer wiper to a five inch headpipe which is smaller in diameter than the well casing.

The next step is attaching an end cap body to the screen, with the nozzle having a first end with a rim for attachment to the screen bottom edge and the nozzle further including a tapering frustoconical interior surface, which tapers towards threads for receiving the left-handed threads of a drill string coupling. The nozzle has a second end with a water injection nozzle, and a check valve is located in the end cap body. The check-valve allows water to flow in a direction from the first end to the second end.

The next step involves pushing the drill string, with the screen and headpipe and end cap body attached, down the drill casing until the headpipe is past the packer wiper in the casing, with a flow of water flowing out of the water injection nozzle to displace sand when the end cap body enters the layer of sand.

The next step is stopping the descent of the screen and the attached end cap body in the well casing when the screen is partly exposed to the sand layer.

The next step is ceasing the pumping of water through the end cap body, which allows the check-valve to set and blocks the backflow of water through the check valve, into the interior of the screen. However, water may enter through the screen, which is designed to keep sand out and to let water pass.

The next step is turning the drill screen with the coupler in a clockwise fashion to disengage the coupler from the end cap body. The threaded connections in the drill screen tend to tighten when turned in a clockwise direction.

The next step is removing the coupler and the attached drill string from the casing of the well, leaving the screen and the end cap body in the sand layer, so that water from the sand can enter the screen and travel up the headpipe and into the casing.

DESCRIPTION OF THE PREFERRED EMBODIMENTS

Figure 1:
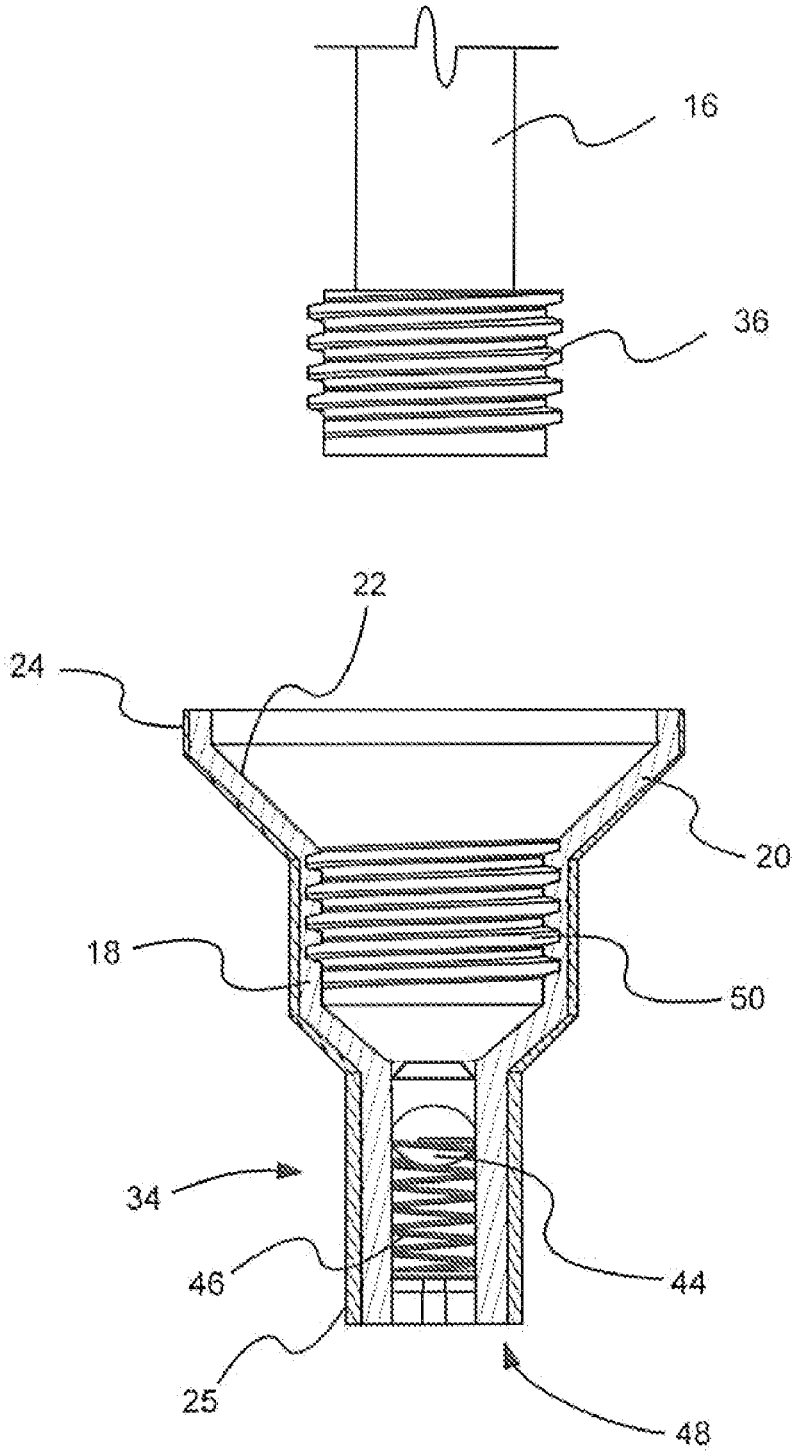
FIG. 1 is a cross-sectional view of the well drilling wash down end cap of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

Fluid such as oil, natural gas and water are obtained from subterranean geologic formation by drilling a well that penetrates into the fluid bearing formation. Once the well has been drilled to a certain depth the bore hole wall must be supported to prevent collapse. This typically involves the installation of a casing string and cementing between the casing and the borehole to provide support for the borehole structure. After cementing a casing string in place, the drilling to greater depths can commence. The drill bit passes through the inner diameter of the casing and continues to drill below the bottom of the casing.

For the purpose for drilling a well for water, a borehole is drilled through a layer of material which is at least partially impervious to water, such as a layer of clay, and into a layer of material with is permeable to water, such as sand. The borehole and casing are typically extended through the clay layer, but need not be extended into the sand layer. Once the borehole and casing have extended into the sand layer, a section of pipe which is perforated with many holes is extended into the sand layer. This section of pipe is called a screen section, and is designed to prevent or restrict the inflow of sand or other particulate matter from the water bearing formation into the production tubing. In order to insert the screen section into the layer of sand, the sand directly below the screen layer must be dislodged by a jet of water. The present invention provides an end cap which is attached to the end of the screen section and which facilitates dislodging and fluidizing the sand so that the screen section may be pressed into place within the sand layer. The invention provides for a jet of water to blast sand away from the path of the screen section, and it provides a check valve so that the water and sand do not enter through the injection nozzle of the end cap.

In the following description and in the figures, like elements are identified with like reference numerals. The use of "e.g.," "etc," and "or" indicates non-exclusive alternatives without limitation unless otherwise noted. The use of "including" means "including, but not limited to," unless otherwise noted.

Figure 2:
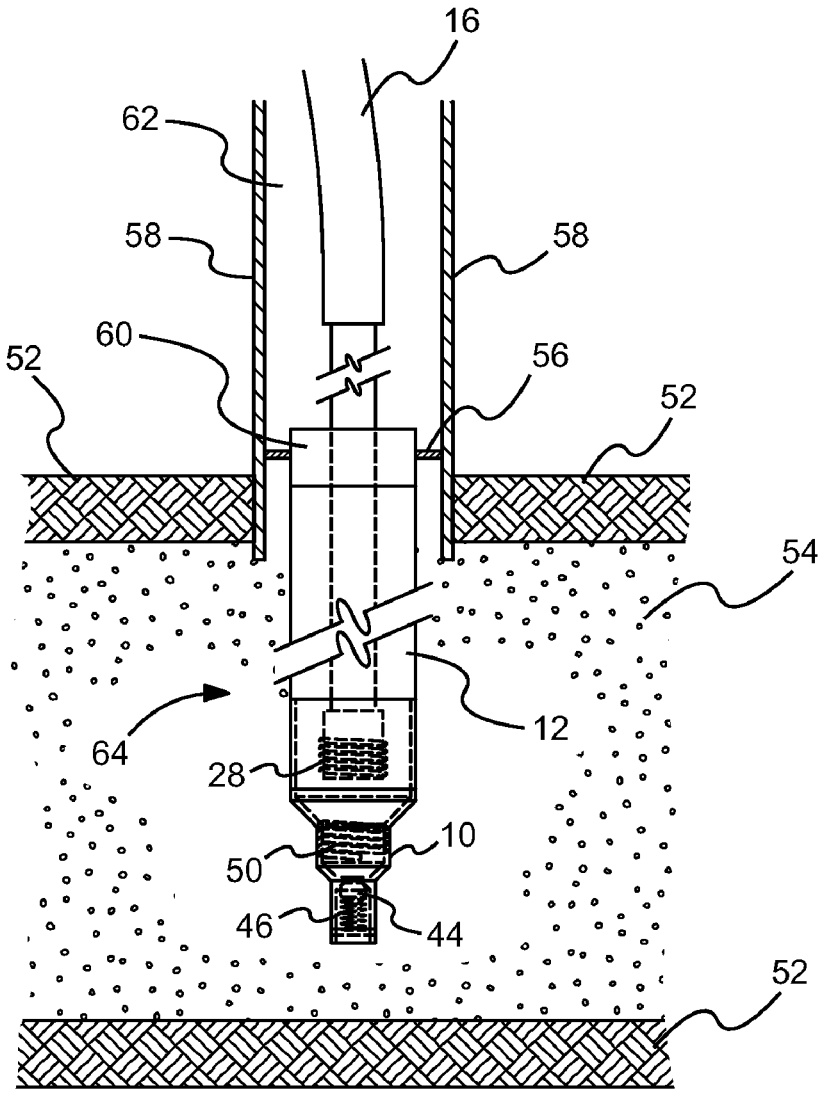
FIG. 2 is a cross-sectional view of the end cap of the invention attached to a drill screen and positioned in a geologic formation.

In FIGS. 1-2 the well drilling wash down end cap of the invention is shown to advantage.

FIG. 1 shows the well drilling wash down end cap as 10. The end cap includes an end cap body 18, a first conical portion 20 a second conical portion 30 a first end of the end cap body 24 and a second end of the end cap body 25. Also shown are a first conical interior surface 22 and interior threads 50. Near the second end 25 of the end cap is located an exit orifice 42, through which water may flow from the drill string 16. The exit orifice 42 is closed by a check valve 34, which in the embodiment shown in FIG. 1 is comprised of a ball 44 which is pressed into the exit orifice 42 by a spring 46. The ball and spring are enclosed within a retaining tube 48. When pressure from water in the drill string 16 exceeds the strength of the spring 46, the ball 44 is pushed aside and water exits the end cap 10 through the exit orifice 42. Also shown in FIG. 1 is a drill string coupler 36, by which the drill string 16 is attached to the end cap 10.

FIG. 2 shows the end cap 10 of the invention as it would appear in operation in a geological formation. The end cap of the Invention is utilized after a bore hole 62 is drilled into a geological formation. This would typically be a clay layer 52, such as is shown in FIG. 2. A second clay layer 52 is positioned below the bore hole 62, with the area between the clay layers being a sand layer 54. Since the clay layers are impervious to water, water would collect in the sand layer and be available for pumping out of the bore hole 62. A drill screen 16 is used to drill the bore hole 62, with a drilling bit of a conventional design used to drill the bore hole. Once the bore hole is through the top clay layer 52, the drill screen with the drill bit attached would be removed from the bore hole. In the process of drilling, casing 58 would be placed in the bore hole to line the sides of the bore hole to prevent cave-in of the material through which the bore hole is drilled.

The casing would typically be made of steel tubing 0.258-0.322 inches thick, and 6 to 8 inches in diameter. Various sizes of casing would be suitable for different depths and volumes of bore holes and would be tailored to the requirements of a particular bore hole. A packing material or packing device 56 is placed near the end of the casing, in order to provide a seal from sand entering the bore hole above the packing 56.

A screen assembly 64 is assembled which is configured as shown in FIG. 2. The screen assembly includes a collar 60, a screen section 12, with the end cap of the invention attached to the bottom end of the screen section 12. The screen assembly is attached to the drill string 16 by a pipe which extends into the middle of the screen section 12, and which has at its end a drill screen coupler 28. The drill screen coupler is externally threaded and fits in corresponding threads which are interior threads 50 inside the end cap 10.

The drill string 16 is made up of a number of sections which are screwed to each other in right handed thread connections. The drill string rotates in a clockwise direction which tends to tighten all of the threads between all of the sections of pipe in the drill string. It also tightens against the connection with the drill bit, so that clockwise rotation tightens all of the connections. The drill string coupler 28 has left handed threads which attach to corresponding left handed interior threads 50 of the end cap 10 of the invention. The screen section 12 is thus tightened on to the drill string above the surface of the ground. It is then lowered into the bore hole 62 and through the packing 56 until the packing 56 engages the collar 60. When the packing 56 engages the collar 60, the screen section 12 extends substantially into the sand layer 54, and is ready to admit water from the sand layer, while excluding sand from going into the bore hole 62. When the screen section 12 is being inserted into the sand layer 54, water is forced through the drill string and into the second end of the end cap body. There, it overcomes the resistance of the ball 44 and the spring 46, and shoots out the end of the end cap. It thus forms a hydraulic drill bit which displaces sand and allows the screen section to be forced into the sand layer. When water pressure in the drill string is reduced, the ball 44 seals the end cap from water and sand entering the end cap 10.

Once the screen section 12 is thus positioned in the sand layer, the drill string 16 can be turned clockwise, which would tend to tighten all of the threaded connections of the drill string, except for the drill screen coupler 28. This would be loosened and eventually disengaged, allowing the drill string 16 to be lifted out of the bore hold completely. With the screen section 12 in place in the sand layer 54, water would begin to flow through the screen section and into the casing 58. Water would be pumped in the casing 58 to provide water at the surface of the well.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other features and advantages of the claimed invention will become readily apparent to those skilled in this art from the following detailed description describing preferred embodiments of the invention, simply by way of illustration of the best mode contemplated by carrying out my invention. As will be realized, the invention is capable of modification in various obvious respects all without departing from the invention. Accordingly, the drawings and description of the preferred embodiments are to be regarded as illustrative in nature, and not as restrictive in nature.

I claim:

1. A method of inserting a screen into an underground layer of sand which has been reached by drill casing, comprising the steps of:

attaching a drill string coupler with half right-handed threads and half left-handed threads, to a drill string using the right-handed threads;

inserting a packer in the interior of the casing at a point above the end of the casing;

attaching a screen configured for a tight interfit with said packer to a headpipe smaller in diameter than said well casing attaching an end cap body to said screen, with said nozzle having a first end with a rim for attachment to a screen bottom edge, and said nozzle further comprising a tapering frustoconical interior surface tapering to threads for receiving said left handed threads of said drill string coupling, with said end cap body having a second end with a water injection nozzle, with a check valve in said end cap body, for allowing water to flow in a direction from said first end to said second end;

pushing said drill string with said screen and said headpipe and end cap body attached down said drill casing, until said headpipe is past the packer in said casing, with a flow of water flowing out of said water injection nozzle to displace sand when said end cap body enters said layer of sand;

stopping the descent of said screen and attached end cap body in the well casing when said screen is partway exposed to said sand layer;

ceasing the pumping of water through said end cap body, and allowing said check valve to set and block backflow of water into said screen;

turning said drill string with said coupler in a clockwise direction to disengage said coupler from said end cap body;

removing said coupler and attached drill string from said end cap body, and leaving said screen and end cap body in said sand, so that water from said sand can enter said screen and travel up said headpipe.

* * * * *